United States Patent [19]

Cha

[11] 4,369,841

[45] Jan. 25, 1983

[54] METHOD FOR IGNITING AN IN SITU OIL SHALE RETORT

[75] Inventor: Chang Y. Cha, Golden, Colo.

[73] Assignee: Occidental Oil Shale, Inc., Grand Junction, Colo.

[21] Appl. No.: 220,850

[22] Filed: Dec. 29, 1980

[51] Int. Cl.[3] ..... E21B 43/24

[52] U.S. Cl. ..... 166/251; 166/259

[58] Field of Search ..... 166/251, 256, 259, 260; 299/2

[56] References Cited

U.S. PATENT DOCUMENTS

| | | | |
|---|---|---|---|
| 2,780,449 | 2/1957 | Fisher et al. | 166/259 |
| 3,032,102 | 5/1962 | Parker | 166/251 |
| 3,126,954 | 3/1964 | Campion | 166/260 |
| 3,454,365 | 7/1969 | Lumpkin et al. | 23/230 |
| 3,892,270 | 7/1975 | Lindquist | 166/251 |
| 3,952,801 | 4/1976 | Burton | 166/256 |
| 4,027,917 | 6/1977 | Bartel et al. | 299/2 |
| 4,147,389 | 4/1979 | Bartel et al. | 299/2 |
| 4,224,990 | 9/1980 | Cha | 166/251 |
| 4,245,701 | 1/1981 | Chambers | 166/260 |
| 4,301,866 | 11/1981 | Burton et al. | 166/260 |

*Primary Examiner*—Stephen J. Novosad

*Attorney, Agent, or Firm*—Christie, Parker & Hale

[57] ABSTRACT

An in situ oil shale retort is formed in a subterranean formation containing oil shale. The retort contains a fragmented permeable mass of particles containing oil shale which is ignited by introducing fuel and air through a passage leading to the fragmented mass. The amount of air provided is in the range of from about ⅓ more than the amount of air required to stoichiometrically combine with the fuel to about twice the amount of air required to stoichiometrically combine with the fuel. The fuel/air mixture is ignited and hot combustion gases pass downwardly into the fragmented mass. The hot combustion gases heat oil shale particles above the self-ignition temperature of such particles, thereby forming a primary combustion zone in the fragmented mass. Introduction of fuel is discontinued when the concentration of oxygen in off gas from the retort decreases to below a first selected value. The surface of the fragmented mass is cooled and then fuel is re-introduced into the retort, forming a secondary combustion zone below the surface of the fragmented mass for spreading the primary combustion zone. When the concentration of oxygen in off gas from the retort decreases below a second selected value, the secondary combustion zone is extinguished.

60 Claims, 1 Drawing Figure

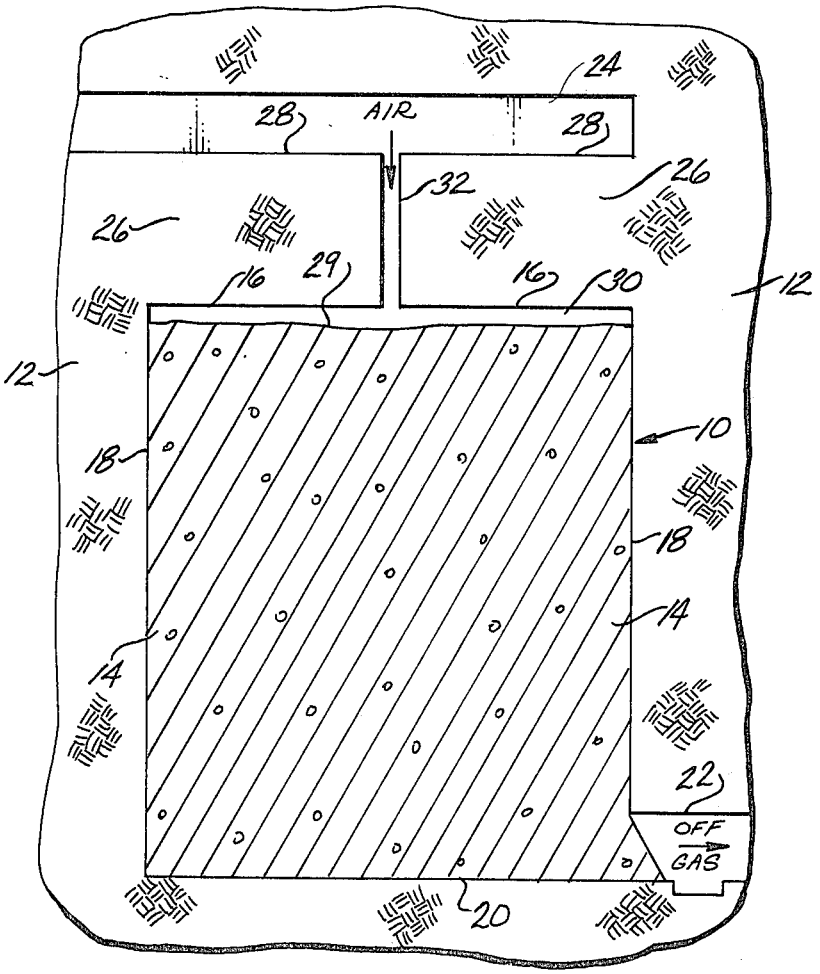
24
28
AIR
28
32
26
26
29
16
16
30
12
12
10
18
18
14
14
22
OFF
GAS
20

METHOD FOR IGNITING AN IN SITU OIL SHALE RETORT

FIELD OF THE INVENTION

This invention relates to processing of oil shale and, more particularly, to a method for igniting the oil shale in an in situ oil shale retort.

BACKGROUND OF THE INVENTION

The presence of large deposits of oil shale in the semi-arid, high plateau region of the western United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising a marlstone deposit with layers containing an organic polymer called "kerogen" which, upon heating, decomposes to produce liquid and gaseous products, including hydrocarbon products. It is the formation containing kerogen that is called "oil shale" herein and the liquid hydrocarbon product is called "shale oil".

A number of methods have been proposed for processing oil shale which involve either mining the kerogen-bearing shale and processing the shale on the surface, or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-supplying gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett.

It has been found desirable in some embodiments to have an intact subterranean base of operation above the fragmented permeable mass of formation particles in an in situ oil shale retort. Such a base of operation facilitates the drilling of blastholes into underlying formation for forming a fragmented mass in the retort and facilitates ignition over the entire top portion of the fragmented mass. Additionally, having a base of operation above the fragmented permeable mass of formation particles permits control of introduction of oxygen-supplying gas into the retort, provides a location for testing properties of the fragmented permeable mass, such as distribution of void fraction, and provides a location for evaluation and controlling performance of the retort during operation.

The base of operation is separated from the retort by a layer of unfragmented formation extending between the top boundary of the retort and the floor of such a base of operation. The layer of unfragmented formation is termed a "sill pillar" which acts as a barrier between the in situ oil shale retort and the base of operation during retorting operations. It is, therefore, important that the sill pillar remain structurally sound, both for supporting the base of operation and for preventing entry of heat and gases into the base of operation during the retorting process.

Techniques for forming an in situ oil shale retort containing a fragmented permeable mass of formation particles and having a sill pillar of unfragmented formation between the top of the fragmented mass and an overlying base of operation are described in U.S. Pat. No. 4,118,071 by Ned M. Hutchins and in application Ser. No. 929,250 filed July 31, 1978, by Thomas E. Ricketts, entitled "Method for Explosive Expansion Toward Horizontal Free Faces for Forming an In Situ Oil Shale Retort", now U.S. Pat. No. 4,192,554. U.S. Pat. No. 4,118,071 and application Ser. No. 929,250, now U.S. Pat. No. 4,192,554, are incorporated herein by this reference. The in situ oil shale retort formed by the method disclosed in application Ser. No. 929,250 may not be completely full of oil shale particles, i.e., there can be a void space between the upper surface of the fragmented mass of oil shale particles and the top boundary of the retort.

In other embodiments, the formation overlying the fragmented permeable mass of formation particles extends all the way to the ground surface. In such an embodiment, blastholes are drilled through the overlying formation and ignition of the fragmented mass of particles is accomplished from the ground surface.

Examples of other techniques used for forming in situ oil shale retorts are described in U.S. Pat. No. 4,043,595 by French; U.S. Pat. No. 4,043,596 by Ridley; U.S. Pat. No. 4,043,597 by French; and U.S. Pat. No. 4,043,598 by French et al, each of which is incorporated herein by this reference.

In the past, a variety of techniques have been developed for igniting oil shale particles in an in situ oil shale retort in order to establish a combustion zone. Such techniques are disclosed in U.S. Pat. No. 3,990,835 and U.S. Pat. No. 3,952,801, both by Robert S. Burton, III. According to the techniques disclosed in these patents, a hole is bored to the top of the fragmented permeable mass and a burner is lowered through the borehole to the oil shale to be ignited. A mixture of combustible fuel, such as LPG (liquefied petroleum gas), diesel oil, or shale oil, and oxygen-containing gas, such as air, is burned in the burner and the resultant flame is directed downwardly toward the fragmented permeable mass. The burning is conducted until a substantial portion of the oil shale has been heated above its ignition temperature so that combustion of the oil shale in the fragmented mass is self-sustaining after ignition. Thereafter, oxygen-supplying gas is introduced to the retort to advance the combustion zone through the fragmented mass.

When a retort is formed having a void over the top of the fragmented permeable mass, it is important to ensure that portions of overlying unfragmented formation do not slough into the retort. Sloughing of material from unfragmented formation is increased as the temperature of such unfragmented formation is increased.

When material sloughs into the retort, the time required to ignite such a retort is significantly increased. This results in additional fuel usage, thereby increasing the cost of retorting.

Additionally, when a retort is formed having a sill pillar of unfragmented formation above such a fragmented permeable mass of formation particles, sloughing can cause deterioration of the sill pillar's structural integrity and/or complete structural failure. When a sill pillar fails, gases and heat from the retorting operation can escape into the base of operation, rendering the base of operation uninhabitable, thereby increasing the cost of such retorting operations substantially.

Therefore, during the ignition process, it can be important to minimize heating of the bottom of unfragmented formation overlying the fragmented mass in the retort.

It is also important that an ignition process provide that a combustion zone which is initially formed is not inadvertently extinguished during the process. If, for example, a combustion zone is extinguished, it is estimated that three or more times the amount of fuel can be required to re-ignite the fragmented permeable mass than was originally required. Also, if the combustion zone has advanced more than about ten feet into the fragmented permeable mass and is then extinguished, it may not be possible to re-ignite the retort, regardless of the amount of fuel used since the combusted oil shale above the locus of the combustion zone contains little, if any, combustible material.

Additionally, it can be important that an ignition process provide for forming a combustion zone which has propagated across the entire horizontal cross-section of the fragmented permeable mass of formation particles. Having a combustion zone across the entire horizontal cross-section of the retort enhances uniform retorting and minimizes bypassing of oil shale by the combustion and retorting zones during the retorting process.

SUMMARY OF THE INVENTION

This invention provides a method for igniting an in situ oil shale retort in a subterranean formation containing oil shale. The retort contains a fragmented permeable mass of formation particles containing oil shale having an average void fraction greater than about 15%. Fuel is introduced through a passage leading to the fragmented permeable mass of formation particles in the in situ oil shale retort. An excess of air is introduced through such a passage for burning the fuel. The amount of air provided is at least about one-third more than the amount of air required to stoichiometrically combine with the fuel, preferably from at least about one-third more up to about twice the amount of air required to stoichiometrically combine with the fuel. The fuel/air mixture is ignited for heating a portion of the fragmented mass above its self-ignition temperature for forming a primary combustion zone in the fragmented mass. Off gas is withdrawn from the fragmented mass and the off gas is monitored for the concentration of oxygen contained therein. The ratio of fuel-to-air in the fuel/air mixture is substantially reduced when the concentration of oxygen in the off gas decreases below a selected value. Further, a secondary combustion zone can be established in the fragmented mass for aiding propagation of the primary combustion zone laterally across the retort. The secondary combustion zone is extinguished when satisfactory propagation of the primary combustion zone is achieved.

BRIEF DESCRIPTION OF THE DRAWING

These and other features, aspects, and advantages of the present invention will become more apparent when considered with respect to the following description, appended claims, and accompanying drawing, wherein the drawing illustrates, semi-schematically, a vertical cross-section of an in situ oil shale retort operated in accordance with practice of principles of this invention.

DETAILED DESCRIPTION

Referring to the accompanying drawing, there is shown a semi-schematic vertical cross-sectional view of an exemplary embodiment of an in situ oil shale retort 10 formed in a subterranean formation 12 containing oil shale. The in situ oil shale retort contains a fragmented permeable mass of formation particles 14 containing oil shale. The retort is bounded by a top boundary 16, generally vertically extending side boundaries 18, and a bottom boundary 20 of unfragmented oil shale formation.

Access to the bottom of the in situ oil shale retort is provided through a horizontal access drift or tunnel 22 at the bottom of the retort. In one embodiment, the tunnel 22 is first formed in the subterranean oil shale formation and a portion of the formation is then removed through the tunnel to form an open space in the formation which defines the bottom or floor of the in situ oil shale retort. Oil shale above this open space is then fragmented with explosive, both to form a cavity defined by the boundaries of the retort and to substantially fill the cavity with a fragmented permeable mass of formation particles.

If desired, access to the bottom of the oil shale retort can be provided by one or more raises which extend upwardly from a lateral drift into a bottom portion of the fragmented mass.

The average void fraction of the fragmented permeable mass of particles formed can be at least about 15%, preferably between about 15% and 35%.

It is not desired that the fragmented permeable mass have a void fraction much less than about 15% because of the low permeability of a fragmented mass having less void space and consequent high pressure differential needed for gas flow through the retort. Additionally, when the void fraction is less than about 15%, non-uniformity of void fraction distribution can cause significant gas flow maldistribution.

Economic considerations are the principal reasons why a fragmented permeable mass of oil shale particles with a void fraction greater than about 35% is not desired, e.g., the cost of excess mining and retorting less oil shale. Preferably, the average void fraction of the fragmented permeable mass is less than about 35%.

There can also be provided an open base of operation 24 mined into the subterranean formation above the top boundary which extends across the in situ retort. The base of operation provides effective access to substantially the entire horizontal extent of such a retort. The base of operation can be used during the formation of the retort and additionally can facilitate ignition of the fragmented permeable mass of formation particles formed in the retort. The base of operation can also provide for control of introduction of fuel and oxygen-supplying gases into the retort and for evaluating performance of the retort during its operation. If desired, such an underground base of operation can be deleted and the aforementioned operations performed from the ground surface. Alternatively, access can be afforded from a drift or drifts extending above or adjacent the retort.

In the exemplary embodiment of a sill pillar 26 of unfragmented formation between the fragmented permeable mass of oil shale particles and the open base of operation 24, the top 28 of the sill pillar is the floor of the base of operation and the bottom of the sill pillar is the top boundary 16 of the retort.

In an exemplary embodiment, there is a void space 30 remaining between the upper surface 29 of the fragmented permeable mass of formation particles and the bottom of the unfragmented formation above the fragmented mass after explosive expansion of oil shale during the formation of the retort.

A passage 32 is drilled through the unfragmented formation above the fragmented permeable mass downwardly to the top of the fragmented permeable mass. If desired, more than one passage can be provided, but for clarity of illustration herein, the invention will be described in terms of using one such passage.

Retorting of the fragmented permeable mass of oil shale particles is initiated by establishing a primary combustion zone in an upper portion of the fragmented mass and by advancing the primary combustion zone through the mass by introducing an oxygen-supplying gas on the trailing side of such a primary combustion zone. Hot gases passing through the primary combustion zone cause retorting of oil shale in a retorting zone on the advancing side of the combustion zone. An off gas containing gaseous products of retorting, combustion gas, and unreacted components of the retort inlet mixture is withdrawn from the retort on the advancing side of the retorting zone.

As used herein, the term "retorting zone" refers to the portion of the retort where kerogen in oil shale is being decomposed to liquid and gaseous products, leaving residual carbonaceous material in the retorted oil shale.

The term "primary combustion zone" refers to a portion of the retort where the greater part of the oxygen in the retort inlet mixture that reacts with the residual carbonaceous material in the retorted oil shale is consumed.

Initial heating for ignition of the fragmented permeable mass can be accomplished by burning a fuel in the passage leading to the fragmented permeable mass or in the void space above the fragmented mass, e.g., by burning the fuel in a burner positioned in such passage or in such void space. This results in a localized high temperature zone in the fragmented mass of formation particles which contains products of retorting, including residual carbon which can support combustion.

In an exemplary embodiment, the fragmented mass of formation particles 14 is ignited by introducing fuel and an oxygen-supplying gas into a burner in the passage 32 leading to the mass of formation particles. If a substantial void space exists over the fragmented mass, the effective lower end of the passage can be extended to nearer the surface of the fragmented mass by extending a conduit through the passage into the void space.

An excess of oxygen-supplying gas is used for providing an amount of oxygen greater than the amount required for complete combustion of the fuel. For example, it is desired that the quantity of oxygen-supplying gas introduced is in the range of from about $\frac{1}{3}$ more than the amount required to stoichiometrically combine with the fuel, preferably from about $\frac{1}{3}$ more up to about twice the amount required to stoichiometrically combine with the fuel. Additionally, it is important that the amount of oxygen-supplying gas provided during ignition of the fragmented mass be less than the amount which would destabilize or extinguish the flame resulting from combustion of the fuel.

By providing oxygen-supplying gas to fuel ratios in accordance with the present invention, a heated gas having an oxygen concentration of from about 5% to about 10% is provided adjacent the surface of the fragmented mass. Gas concentrations are expressed herein in the conventional manner as percent by volume. This heated gas passes into the fragmented oil shale, heating the oil shale to above its self-ignition temperature, thereby forming a primary combustion zone in the fragmented mass of oil shale particles. At least a portion of the excess oxygen is consumed in the primary combustion zone.

If too little excess oxygen is used, the flame temperature provided by ignition of the mixture of oxygen-supplying gas and fuel can be too high and fusion of oil shale can occur. Further, the quantity of fuel required to effect ignition of the retort is increased since there is ineffective use of residual carbon in retorted oil shale.

If too much excess oxygen-supplying gas is used, maintenance of a stable flame at sufficiently high temperatures is impaired and a prolonged time is required for ignition. Increasing the time required for ignition increases the fuel requirement, resulting in increased cost of retorting.

The excess oxygen-supplying gas tends to burn some of the products resulting from retorting the oil shale, thereby releasing heat. This not only saves fuel, but minimizes heat loss since part of this heat is generated in the fragmented mass, rather than in the passage leading to such a fragmented mass.

Use of excess oxygen can also reduce the ignition time, resulting in a reduction of fuel required by up to 50% or even more, as compared to ignition without excess oxygen-supplying gas.

The oxygen-supplying gas can, for example, be air, oxygen-enriched air, air diluted with off gas or steam, or the like.

The fuel can, for example, be propane, butane, natural gas, off gas from an oil shale retort, LPG, or other combustible materials such as diesel oil, shale oil, or the like.

For purposes of the present description, LPG is used as the fuel and air is provided as the oxygen-supplying gas. Similarly, in the exemplary embodiment herein, a burner is lowered into the passage 32 to provide the ignition means for igniting the fragmented mass. Details of burners useful in practice of principles of this invention can be found in U.S. Pat. Nos. 3,952,801 and 3,990,835 by Burton, both of which are incorporated herein by this reference.

LPG and air are supplied to the burner and the mixture is ignited. While the actual location of the flame is determined in part by the air and fuel flow rates, it is desirable that the principal combustion of the fuel occurs at a location above the surface of the fragmented mass. It is also desirable that the flame not contact the top surface of the fragmented permeable mass because this can cause fusion in oil shale which occurs when the oil shale temperature is increased to above about 2000° F.

Initially, a LPG/air mixture is provided to the burner with the air in excess of the stoichiometric amount to combine with the fuel. In one embodiment, air is initially in an amount about $\frac{1}{3}$ more than the amount required for stoichiometric combustion of the fuel.

For example, when the amount of LPG supplied to the retort is about 0.02 SCFM/ft$^2$ (standard cubic feet per minute per square foot of the horizontal cross-sectional area of the retort), the amount of air supplied to the retort is preferably about 0.6 SCFM/ft$^2$. The amount of air required to stoichiometrically combine with 0.02 SCFM/ft$^2$ of LPG is about 0.45 SCFM/ft$^2$ of air.

If too much excess air is provided, the flame can remain unstable for long periods of time and conversely if too little excess air is provided, the flame can be too hot, resulting in damage to the burner or fusion of oil shale. An excess of air which is about $\frac{1}{3}$ more than the amount of air required to stoichiometrically combine with the fuel is sufficient to maintain a flame temperature for providing ignition gas entering the fragmented permeable mass which is no hotter than about 1800° F., thereby minimizing possibility of damage to the burner and also clearly avoiding fusion of the oil shale.

Generally, the burner flame does not attain a desired degree of stability until the components of the burner and the formation surrounding the burner are heated. For example, it has been found that after about two to four hours, and generally after about three hours, the flame has been stabilized when the above described LPG/air mixture is used.

Having excess air at about $\frac{1}{3}$ more than the amount of air required to stoichiometrically combine with the fuel provides about 5% to 6% oxygen in gas entering the fragmented mass for enhancing ignition of the retort during the time it takes to stabilize the burner flame.

After the flame is stabilized, the quantity of fuel is decreased or the quantity of air is increased for providing an amount of air introduced into the burner which is about $\frac{1}{2}$ more than the amount of air required to stoichiometrically combine with the fuel.

For example, when the initial amount of LPG supplied to the retort is about 0.02 SCFM/ft$^2$, the supply of LPG can be decreased to about 0.018 SCFM/ft$^2$ while the total amount of air supplied to the retort remains at about 0.6 SCFM/ft$^2$. This amount of air, i.e., 0.6 SCFM/ft$^2$, is about one and one-half times the amount of air required to stoichiometrically combine with 0.018 SCFM/ft$^2$ LPG.

This increases the amount of oxygen introduced into the fragmented permeable mass which enhances propagation of the primary combustion zone being formed. For example, when air is provided in an amount about $\frac{1}{2}$ more than the amount required to stoichiometrically combine with the fuel, there is about 6% to 7% oxygen in the gas entering the fragmented permeable mass of oil shale particles. The oxygen can combine with oil shale which is heated above its self-ignition temperature to propagate the primary combustion zone. This ratio of air-to-fuel provides a desirable combination of flame temperature for initial heating of oil shale and amount of excess oxygen for enhancing propagation of the primary combustion zone.

Once a sufficient portion of the fragmented permeable mass of formation particles has been heated to above its self-ignition temperature, the percentage of excess air can be gradually increased to further enhance propagation of the primary combustion zone.

The self-ignition temperature of carbonaceous material in oil shale can vary with various conditions, such as total gas pressure and the partial pressure of oxygen in the retort and may be as low as 500° F., although 750° F. is usually considered a minimum. During operation of an in situ retort, it is preferred to consider 900° F. as the self-ignition temperature of oil shale.

In order to determine how much oil shale has been heated above its self-ignition temperature, the oxygen concentration of off gas withdrawn through the retort outlet 22 is monitored. Some oxygen can be present in off gas withdrawn from the retort as the inlet mixture bypasses regions heated above the ignition temperature or passes through heated regions of limited thickness more rapidly than it can react with combustible materials within larger particles containing oil shale. As the amount of oil shale heated above its self-ignition temperature increases, bypassing decreases and the thickness of the primary combustion zone increases so that oxygen is more thoroughly consumed. This causes the amount of oxygen remaining in the off gas to decrease.

It has been found that when the concentration of oxygen in the off gas decreases to less than about 5%, and preferably to less than about 3%, the amount of excess air supplied can be increased without extinguishing the primary combustion zone and without causing instability of the burner flame.

In an exemplary embodiment, when the concentration of oxygen in the off gas decreases to less than about 3%, excess air is increased gradually or the amount of fuel is decreased gradually until about twice the amount of air required to stoichiometrically combine with the fuel is provided. This can be achieved in several hours. For example, the amount of fuel can be reduced in about equal increments every half hour for about two hours until twice the amount of air required to stoichiometrically combine with the fuel is provided.

This can be achieved, for example, by maintaining the total amount of air being supplied to the retort at about 0.6 SCFM/ft$^2$ while decreasing the amount of LPG from about 0.018 SCFM/ft$^2$ to about 0.013 SCFM/ft$^2$. This amount of air, i.e., 0.6 SCFM/ft$^2$, is about twice the amount of air required to stoichiometrically combine with 0.013 SCFM/ft$^2$ LPG.

When this proportion of excess air is attained, the mixture of hot ignition gas and air entering the primary combustion zone formed in the fragmented mass has an oxygen content of about 10% to 11%. A portion of such excess oxygen is consumed in the primary combustion zone forming in the fragmented mass, thereby adding additional heat for propagating the primary combustion zone, both downwardly through the fragmented mass and radially outwardly toward the side boundaries 18 of the retort.

As the primary combustion zone propagates and grows, additional oxygen is consumed so that the extent of the combustion zone can be estimated by the amount of oxygen remaining in the off gas.

Having air provided in an amount about twice that required to stoichiometrically combine with the fuel provides for a desirable rate of propagation of such a combustion zone while not causing instability of the burner flame. When the amount of air is increased to more than about twice that amount required to stoichiometrically combine with the fuel, the flame can become unstable and can even be extinguished. Additionally, if too much excess oxygen is supplied, the temperature of the primary combustion zone can increase to above the temperature at which fusion of oil shale occurs.

After a selected interval which, in an exemplary embodiment, ends when the oxygen concentration in the off gas decreases to less than about 2%, fuel to the burner is turned off. Air in the substantial absence of fuel is introduced into the retort to advance the primary combustion zone through the retort and to cool the upper surface 29 of the fragmented mass.

It has been found that when the oxygen concentration in the off gas is about 2% or less, the amount of oil shale heated to above its self-ignition temperature is sufficient to sustain the primary combustion zone without added heat from the burner flame.

In an exemplary embodiment, the surface of the fragmented mass is cooled from a temperature of about 1600° F. to less than about 1000° F.

It is desired to advance the primary combustion zone into the fragmented mass and to cool the surface of the fragmented mass in order to maintain cool gases in the void space between the upper surface of the fragmented mass and the bottom of the overlying unfragmented formation, i.e., the bottom of the sill pillar. This cools the bottom surface of the overlying formation and decreases the probability of sloughing of material from the overlying formation into the retort.

Additionally, this cooling process moves the primary combustion zone into the fragmented mass a sufficient distance from the void space 30 to minimize the amount of heat radiated into the void space from the primary combustion zone, thus minimizing heating of the bottom surface of overlying formation.

After an interval which, in an exemplary embodiment, ends when the upper surface 29 of the fragmented mass has been adequately cooled, i.e., to less than about 1000° F., sufficient LPG is introduced with the air in a retort inlet mixture for establishing a secondary combustion zone in the fragmented permeable mass upstream from the primary combustion zone. It is desired that the ignition temperature of the LPG/air mixture is higher than the temperature of the surface of the fragmented mass so that the secondary combustion zone is formed below the surface. Having a secondary combustion zone formed below the surface minimizes the amount of heating of the surface of the sill pillar by the secondary combustion zone.

As used herein, the term "secondary combustion zone" refers to that portion of the fragmented permeable mass in the retort where fuel in the retort inlet mixture is consumed.

Ignition of the retort inlet mixture in a secondary combustion zone occurs in a "heated zone" at a location below the cooled surface of the fragmented mass in a region where the temperature of oil shale particles is at about the ignition temperature of the retort inlet mixture. As used herein, the "heated zone" is defined as that region of the fragmented permeable mass between a 900° F. isotherm on the leading side of the primary combustion zone and an 800° F. isotherm on the trailing side of such a combustion zone.

The amount of LPG to be added can be determined by the desired temperature of the secondary combustion zone which can be from about 1400° F. to about 1800° F. When using LPG, the amount of air provided is from about 2 to about 2½ times the amount required to stoichiometrically combine with the LPG. This provides a sufficient amount of oxygen in the retort inlet mixture so that all of the oxygen is not depleted by the secondary combustion zone. The gas mixture which passes from the secondary combustion zone into the primary combustion zone has an oxygen concentration of from about 11% or so to about 14½% to 15%.

U.S. patent application Ser. No. 930,022 filed by me on Aug. 1, 1978, now U.S. Pat. No. 4,191,251, provides additional details relating to establishment and maintenance of a secondary combustion zone in an in situ oil shale retort and is incorporated herein by reference.

The secondary combustion zone formed upstream from the primary combustion zone in the heated mass of oil shale particles aids in propagating the primary combustion zone laterally across the horizontal extent of the retort. This is accomplished because the secondary combustion zone heats oil shale particles to their self-ignition temperature as the secondary combustion zone spreads across the retort.

Having a primary combustion zone spread uniformly substantially across the entire horizontal extent of the retort enhances the yield from an in situ oil shale retort by reducing the extent of the fragmented permeable mass which may be bypassed by such a primary combustion zone. Therefore, before the secondary combustion zone is extinguished, it is desired that the primary combustion zone is spread horizontally across substantially the entire mass of formation particles to the side boundaries of the retort and that a desired rate of retorting is occurring. When ignition is conducted via several inlet passages to the fragmented mass, it is desirable that the combustion zones coalesce so that the primary combustion zone is spread horizontally across substantially the entire horizontal cross-section of the retort.

Methane is a product of retorting oil shale and it has been determined that the rate of retorting can be determined by monitoring the concentration of methane in retort off gas. Because the concentration of methane in retort off gas depends at least in part on the grade of oil shale being retorted, oil shale grade must be taken into account when correlating methane concentration to the desired rate of retorting. When retorting oil shale of an exemplary embodiment, a concentration of methane of about 0.3% to about 0.6% in off gas from the retort indicates that a desirable rate of retorting has been achieved.

Although other products of retorting, such as hydrogen, are present and can be monitored if desired, it is preferred to monitor methane since methane appears to be best indicator of normal retorting.

The concentration of oxygen in the off gas is also monitored, as described hereinabove, and is a good indicator as to the extent of propagation of the primary combustion zone across the retort. As the primary combustion zone spreads across the retort, a decreasing proportion of the retort inlet mixture bypasses the combustion zone. When the primary combustion zone has spread completely across the entire retort, essentially none of the oxygen in the retort inlet mixture bypasses such a primary combustion zone and, therefore, essentially all of the oxygen in such a retort inlet mixture is consumed. It has been found, however, that even when the primary combustion zone has spread across the retort, some oxygen can be found in the off gas. It is believed that such oxygen in retort off gas is not supplied in the retort inlet mixture, but leaks into the retort downstream of the primary combustion zone. It has been determined that satisfactory spreading of the primary combustion zone is indicated when the percentage of oxygen in the off gas falls below about 0.5% and preferably to below about 0.3%.

It can be desirable to use both methane concentration and oxygen concentration in off gas as criteria for determining the time at which to extinguish the secondary combustion zone. For example, when the methane concentration is greater than about 0.3% and the oxygen concentration has fallen to below about 0.3%, fuel to the secondary combustion zone is stopped, thereby extinguishing the secondary combustion zone.

If the methane concentration increases to an acceptable level, for example, to a level greater than about 0.3%, but oxygen concentration remains high, some bypassing of the combustion zone by the inlet mixture is indicated. That is, there is a region through which the inlet gas is passing which is not at a sufficient temperature to sustain combustion. If this is the case, additional startup time or other remedial steps can be taken.

It is desired that, at the time the secondary combustion zone is extinguished, the heated zone formed in the retort has a thickness of from about three to about five feet. It is desired to have a heated zone with at least a three foot thickness so that the primary combustion zone is not extinguished after fuel to the secondary combustion zone is terminated.

After the secondary combustion zone is extinguished, a diluent such as recycled off gas or stream is substituted in the retort inlet mixture for the fuel, i.e., the LPG. It is preferred that the ratio of air-to-diluent provides a concentration of oxygen in the retort inlet mixture of from about 10% to 15%.

The concentration of oxygen within this range to be provided in the retort inlet mixture is determined by several factors. These factors can include the maximum temperature of the primary combustion zone desired and the rate at which the combustion zone is to be propagated downwardly through the retort. For example, having a mass flow rate of oxygen which is higher will advance the combustion zone more rapidly, but will also cause a higher primary combustion zone temperature. Having a lower mass flow rate of oxygen conversely will cause a lower combustion zone temperature and a less rapid advancement.

It is desirable that the combustion zone have a maximum temperature lower than about 1800° F. so that a margin of safety below the 2000° F. fusion temperature of oil shale is provided.

Introduction of the retort inlet mixture comprising air and diluent gas into the retort is continued for advancing the combustion zone and retorting zone downwardly through the fragmented permeable mass of formation particles. Kerogen in the oil shale is thereby retorted to produce liquid and gaseous products and liquid and gaseous products are withdrawn from the product withdrawal drift 22.

The above description of a method for igniting an in situ oil shale retort in a subterranean formation containing oil shale is for illustrative purposes. Because of variations which will be apparent to those skilled in the art, the present invention is not intended to be limited to the particular embodiment described hereinabove. The scope of the invention is defined in the following claims.

What is claimed is:

1. A method for igniting an in situ oil shale retort in a subterranean formation containing oil shale, the retort containing a fragmented permeable mass of formation particles containing oil shale, comprising the steps of:

(a) introducing fuel into a passage leading to a fragmented permeable mass of formation particles in an in situ oil shale retort;

(b) introducing an oxygen-supplying gas into such a passage for forming a fuel/oxygen-supplying gas mixture;

(c) igniting the fuel/oxygen-supplying gas mixture for forming a flame for heating a portion of the fragmented mass above its self-ignition temperature for forming a combustion zone in the fragmented mass, the amount of oxygen-supplying gas provided being in the range of from about one-third more than the amount of oxygen-supplying gas required to stoichiometrically combine with the fuel up to about the amount which would extinguish the flame;

(d) withdrawing off gas from the fragmented mass;

(e) monitoring the off gas for the concentration of oxygen contained therein; and (f) reducing the amount of fuel relative to the amount of oxygen-supplying gas in the fuel/oxygen-supplying gas mixture when the concentration of oxygen in the off gas falls below a preselected value.

2. The method according to claim 1 wherein said preselected value for the concentration of oxygen in the off gas is about 2%.

3. The method according to claim 1 wherein the introduction of fuel into the passage leading to the fragmented permeable mass of formation particles is discontinued when the concentration of oxygen in the off gas decreases below about 2%.

4. The method according to claim 1 comprising the steps of:

discontinuing introduction of fuel into the passage leading to the fragmented mass of formation particles when the concentration of oxygen in the off gas decreases below about 2%;

thereafter introducing a sufficient amount of oxygen-supplying gas into the passage leading to the fragmented mass of formation particles for cooling the surface of the fragmented mass; and re-introducing fuel into the passage leading to the fragmented mass of formation particles for establishing a secondary combustion zone in the fragmented mass downstream from the cooled surface.

5. The method according to claim 4 comprising monitoring the temperature of the surface of said fragmented permeable mass of formation particles adjacent said passage and re-introducing fuel into said passage for establishing the secondary combustion zone when the surface of the fragmented permeable mass has fallen below a preselected temperature.

6. The method according to claim 5 wherein said preselected temperature is about 1000° F.

7. The method according to claim 1 further comprising the steps of monitoring the off gas for the concentration of a preselected constituent contained therein and discontinuing the introduction of fuel into the passage leading to the fragmented mass of formation particles when the concentration of such constituent in the off gas reaches a preselected value.

8. The method according to claim 7 wherein the preselected constituent is methane and fuel is discontinued being introduced into the passage leading to the fragmented mass of formation particles when the concentration of methane in the off gas reaches about 0.3%.

9. A method for igniting an in situ oil shale retort in a subterranean formation containing oil shale, the retort containing a fragmented permeable mass of formation particles containing oil shale, comprising the steps of:

(a) establishing a primary combustion zone in the fragmented permeable mass of formation particles;

(b) establishing a secondary combustion zone in the fragmented permeable mass of formation particles upstream from the primary combustion zone for spreading the primary combustion zone laterally;

(c) withdrawing off gas from the fragmented permeable mass;

(d) monitoring the off gas for the concentration of methane; and (e) extinguishing the secondary combustion zone when the concentration of methane in the off gas reaches a selected value.

10. The method according to claim 9 comprising extinguishing the secondary combustion zone when the concentration of methane in the off gas increases to above about 0.3%.

11. A method for forming a primary combustion zone in a fragmented permeable mass of formation particles containing oil shale in an in situ oil shale retort in a subterranean formation containing oil shale, comprising the steps of:

igniting a mixture of fuel and oxygen-supplying gas, the amount of oxygen-supplying gas provided being at least about one-third more than the amount of oxygen-supplying gas required to stoichiometrically combine with the fuel up to about twice the amount required to stoichiometrically combine with the fuel wherein the amount of oxygen-supplying gas provided is less than the amount that would extinguish the ignition;

directing hot gases from the ignition of fuel and oxygen-supplying gas into the fragmented mass for heating at least a portion of the fragmented mass to above the self-ignition temperature of oil shale;

withdrawing off gas from the fragmented mass;

monitoring the off gas for the concentration of oxygen contained therein; and increasing the amount of oxygen-supplying gas relative to the amount of fuel in the mixture of fuel and oxygen-supplying gas when the concentration of oxygen in the off gas decreases below a selected value.

12. The method according to claim 11 comprising increasing the amount of oxygen-supplying gas relative to the amount of fuel in the mixture of fuel and oxygen-supplying gas when the concentration of oxygen in the off gas decreases below about 5%.

13. The method according to claim 12 comprising discontinuing the introduction of fuel when the concentration of oxygen in the off gas decreases below about 2%.

14. The method according to claim 11 comprising increasing gradually the amount of oxygen-supplying gas relative to the amount of fuel in the mixture of fuel and oxygen-supplying gas when the concentration of oxygen in the off gas decreases below about 4%, for providing a mixture of fuel and oxygen-supplying gas comprising about twice the amount of oxygen-supplying gas required to stoichiometrically combine with the fuel.

15. The method according to claim 11 comprising the steps of:

discontinuing introduction of fuel when the concentration of oxygen in the off gas decreases below about 2%;

thereafter introducing a sufficient amount of oxygen-supplying gas for cooling the surface of the fragmented permeable mass; and thereafter introducing fuel into the fragmented permeable mass for establishing a secondary combustion zone in the fragmented permeable mass downstream from the cooled surface.

16. The method according to claim 15 comprising introducing fuel into the fragmented permeable mass for establishing a secondary combustion zone when the surface of the fragmented permeable mass has been cooled to a temperature below about 1000° F.

17. A method for igniting an in situ oil shale retort in a subterranean formation containing oil shale, the retort containing a fragmented permeable mass of formation particles containing oil shale having an average void fraction greater than about 15%, comprising the steps of:

(a) introducing fuel into a passage leading to such a fragmented permeable mass;

(b) introducing an oxygen-supplying gas through such a passage for burning the fuel, the amount of oxygen provided being in the range of from about one-third more than the amount of oxygen required to stoichiometrically combine with the fuel, up to about twice the amount of oxygen required to stoichiometrically combine with the fuel wherein the amount of oxygen-supplying gas introduced is less than the amount which would extinguish the burning;

(c) withdrawing off gas from the fragmented permeable mass;

(d) monitoring the off gas for the concentration of oxygen contained therein; and (e) reducing the amount of fuel introduced into the passage leading to the fragmented permeable mass when the concentration of oxygen in the off gas decreases below a selected value.

18. The method according to claim 17 wherein the oxygen-supplying gas comprises air.

19. The method according to claim 17 comprising reducing the amount of fuel introduced into such a passage when the concentration of oxygen in the off gas decreases below about 2%.

20. The method according to claim 17 wherein fuel is discontinued being introduced into the passage leading to the fragmented mass of formation particles when the concentration of oxygen in the off gas decreases below about 2%.

21. The method according to claim 17 comprising the steps of:

discontinuing introduction of fuel into the passage leading to the fragmented mass of formation particles when the concentration of oxygen in the off gas decreases below about 2%;

thereafter introducing a sufficient amount of oxygen-supplying gas for cooling the surface of the fragmented permeable mass; and re-introducing fuel for establishing a secondary combustion zone in the fragmented permeable mass downstream from the cooled surface.

22. The method according to claim 17 comprising re-introducing fuel for establishing a secondary combustion zone when the surface of the fragmented permeable mass has been cooled to a temperature below about 1000° F.

23. A method for igniting an in situ oil shale retort in a subterranean formation containing oil shale, the retort containing a fragmented permeable mass of formation particles containing oil shale having an average void fraction greater than about 15%, comprising the steps of:

(a) introducing fuel into a passage leading to a fragmented permeable mass of formation particles in an in situ oil shale retort;

(b) introducing air into such a passage for forming a fuel/air mixture, the amount of air provided being in the range of from about one-third more than the amount of air required to stoichiometrically combine with the fuel up to about twice the amount of air required to stoichiometrically combine with the fuel;

(c) igniting the fuel/air mixture for heating a portion of the fragmented mass above its self-ignition temperature for forming a primary combustion zone in the fragmented mass;

(d) withdrawing off gas from the fragmented mass;

(e) monitoring the off gas for the concentration of oxygen contained therein; and (f) reducing the ratio of fuel-to-air in the fuel/air mixture when the concentration of oxygen in the off gas decreases below a selected value.

24. The method according to claim 23 comprising reducing the ratio of fuel-to-air in the fuel/air mixture when the concentration of oxygen in off gas decreases below about 2%.

25. The method according to claim 23 wherein fuel is discontinued being introduced into the passage leading to the fragmented permeable mass of formation particles when the concentration of oxygen in the off gas decreases below about 2%.

26. The method according to claim 23 comprising the steps of:

discontinuing introduction of fuel into the passage leading to the fragmented mass of formation particles when the concentration of oxygen in the off gas decreases below about 2%;

thereafter introducing a sufficient amount of air for cooling the surface of the fragmented permeable mass; and re-introducing fuel for establishing a secondary combustion zone in the fragmented permeable mass downstream from the cooled surface.

27. The method according to claim 26 comprising re-introducing fuel for establishing a secondary combustion zone when the surface of the fragmented permeable mass has been cooled to a temperature below about 1000° F.

28. The method according to claim 26 additionally comprising monitoring the off gas for the concentration of methane contained therein and extinguishing the secondary combustion zone when the concentration of methane in the off gas increases above a selected value.

29. The method according to claim 28 wherein the selected value of methane concentration in the off gas is about 0.3%.

30. A method for igniting an in situ oil shale retort in a subterranean formation containing oil shale, the retort containing a fragmented permeable mass of formation particles containing oil shale, comprising the steps of:

(a) introducing fuel into a passage leading to the fragmented mass;

(b) introducing sufficient air through the passage for burning the fuel, the principal burning being above the surface of the fragmented mass, for providing a heated gas having an oxygen concentration in the range of from about 5% to about 10% adjacent the surface of the fragmented mass for establishing a primary combustion zone in the fragmented mass;

(c) withdrawing an off gas from the fragmented mass;

(d) after a first selected interval, introducing air in the substantial absence of fuel for cooling the surface of the fragmented mass; and (e) after a second selected interval, introducing air and sufficient fuel for establishing a secondary combustion zone in the fragmented mass.

31. The method according to claim 30 comprising introducing sufficient air through the passage for burning the fuel for providing the heated gas having a temperature no greater than about 1800° F. adjacent the surface of the fragmented mass.

32. The method according to claim 30 additionally comprising monitoring the off gas for the concentration of oxygen contained therein, wherein the first selected interval ends when the oxygen concentration in the off gas decreases to below about 2%.

33. The method according to claim 30 wherein the second selected interval ends when the surface of the fragmented mass is cooled to below about 1000° F.

34. The method according to claim 30 additionally comprising monitoring the off gas for the concentration of oxygen and methane contained therein and maintaining such a secondary combustion zone in the fragmented mass until the concentration of methane in the off gas increases to greater than a selected value and the concentration of oxygen in the off gas decreases to less than about 0.5%.

35. The method according to claim 34 comprising maintaining the secondary combustion zone until a heated zone having a thickness of at least about three feet is formed in the fragmented mass.

36. The method according to claim 34 wherein the selected value of the concentration of methane in the off gas is greater than about 0.3%.

37. A method for igniting an in situ oil shale retort in a subterranean formation containing oil shale, the retort containing a fragmented permeable mass of formation particles containing oil shale comprising the steps of:

(a) introducing fuel into a passage leading to the fragmented permeable mass;

(b) for a first period of time, introducing air through the passage for burning the fuel, the amount of air being about $\frac{1}{3}$ more than the amount of air required to stoichiometrically combine with the fuel for providing a heated gas comprising oxygen entering the fragmented permeable mass for establishing a primary combustion zone in the fragmented mass;

(c) withdrawing off gas from the fragmented mass;

(d) monitoring the off gas for the concentration of oxygen and methane contained therein;

(e) when the concentration of oxygen in the off gas decreases below a first selected value, increasing the ratio of air-to-fuel until the amount of air is about twice the amount of air required to stoichiometrically combine with the fuel;

(f) when the concentration of oxygen in the off gas decreases below a second selected value, discontinuing introduction of fuel while continuing introduction of a sufficient quantity of air for advancing such a primary combustion zone into the fragmented mass and for cooling the surface of said fragmented mass;

(g) after a selected interval, establishing a secondary combustion zone in the fragmented mass by introducing into such a fragmented mass sufficient fuel and air for providing ignition of the fuel below the cooled surface of the fragmented mass; and (h) extinguishing the secondary combustion zone when the concentration of methane in the off gas increases to greater than a selected value and the concentration of oxygen in the off gas simultaneously decreases to less than about 0.5%, by discontinuing introduction of fuel while introducing a mixture of air and a diluent gas into the fragmented permeable mass for advancing the primary combustion zone through the retort.

38. The method according to claim 37 wherein the first selected value of the concentration of oxygen in such an off gas is less than about 5%.

39. The method according to claim 37 wherein the first selected value of the concentration of oxygen in such an off gas is less than about 3%.

40. The method according to claim 37 wherein the second selected value of the concentration of oxygen in the off gas is less than about 2%.

41. The method according to claim 37 wherein the selected interval ends when the surface of the fragmented permeable mass is cooled to less than about 1000° F.

42. The method according to claim 37 wherein the selected value for the concentration of methane in the off gas is greater than about 0.3%.

43. The method according to claim 37 comprising extinguishing the secondary combustion zone when the concentration of methane in the off gas increases to greater than about 0.3% and a heated zone is formed in the fragmented permeable mass having a thickness of at least about three feet.

44. A method for igniting an in situ oil shale retort in a subterranean formation containing oil shale, the retort containing a fragmented permeable mass of formation particles containing oil shale, comprising the steps of:

(a) introducing fuel into a passage leading to the fragmented permeable mass;

(b) for a first period of time, introducing air through the passage for burning the fuel, the amount of air being about one-third more than the amount of air required to stoichiometrically combine with the fuel, for providing a heated gas comprising oxygen entering the fragmented permeable mass for establishing a primary combustion zone in such a fragmented permeable mass;

(c) withdrawing off gas from the fragmented permeable mass of formation particles;

(d) monitoring the off gas for the concentration of oxygen and methane contained therein;

(e) for a second period of time, introducing air through the passage for burning the fuel, the amount of air being about one-half more than the amount of air required to stoichiometrically combine with the fuel;

(f) when the concentration of oxygen in the off gas decreases to less than about 5%, increasing the ratio of air-to-fuel until the amount of air provided is about twice the amount of air required to stoichiometrically combine with the fuel;

(g) thereafter when the concentration of oxygen in the off gas decreases to less than about 2%, discontinuing introduction of fuel while continuing introduction of a sufficient quantity of air for advancing such a primary combustion zone into the fragmented permeable mass and for cooling the surface of the fragmented permeable mass;

(h) after a selected interval, establishing a secondary combustion zone in the fragmented permeable mass by introducing into such a fragmented permeable mass sufficient fuel and air for providing ignition of the fuel below the cooled surface of the fragmented permeable mass; and (i) extinguishing the secondary combustion zone by discontinuing introduction of fuel when the concentration of methane in the off gas increases to greater than about 0.3% and the concentration of oxygen in the off gas simultaneously decreases to less than about 0.5%.

45. The method according to claim 44 comprising the additional step of introducing an air/diluent mixture into the fragmented permeable mass after the secondary combustion zone has been extinguished, the concentration of oxygen in the air/diluent mixture being sufficient for providing a maximum primary combustion zone temperature of less than about 1800° F.

46. The method according to claim 45 wherein the selected interval ends when the surface of the fragmented permeable mass is cooled to below about 1000° F.

47. The method according to claim 45 wherein, after the selected interval, sufficient fuel and air are introduced into the fragmented permeable mass for establishing a secondary combustion zone having a temperature of from about 1400° F. to about 1800° F.

48. A method for igniting an in situ oil shale retort in a subterranean formation containing oil shale, the retort containing a fragmented permeable mass of formation particles containing oil shale, comprising the steps of:

(a) lowering a burner into a retort inlet;

(b) introducing a fuel/air mixture to the burner comprising an amount of air in the range of from about $\frac{1}{3}$ more than the amount of air required to stoichiometrically combine with the fuel up to about twice the amount of air required to stoichiometrically combine with said fuel;

(c) igniting such a fuel/air mixture for providing burning above the fragmented permeable mass and resulting in hot ignition gases entering the fragmented permeable mass to establish a primary combustion zone;

(d) withdrawing off gas from the fragmented permeable mass;

(e) monitoring the off gas for the concentration of oxygen contained therein;

(f) when the concentration of oxygen in the off gas decreases below a selected value, discontinuing introduction of fuel to the burner while continuing introduction of air for advancing the primary combustion zone through the retort and for cooling the surface of the fragmented permeable mass;

(g) after a selected interval, introducing fuel into the fragmented permeable mass for establishing a secondary combustion zone in the fragmented permeable mass for spreading the primary combustion zone laterally across said fragmented permeable mass; and (h) discontinuing introduction of fuel into the fragmented permeable mass, thereby extinguishing the secondary combustion zone.

49. The method according to claim 48 wherein the selected value of the concentration of oxygen in the off gas is about 2%.

50. The method according to claim 48 wherein the selected interval ends when the surface of the fragmented permeable mass is cooled to below about 1000° F.

51. The method according to claim 48 additionally comprising monitoring the off gas for the concentration of methane contained therein and discontinuing introduction of fuel into the fragmented permeable mass, thereby extinguishing the secondary combustion zone when the concentration of methane in the off gas increases above a selected value.

52. The method according to claim 51 wherein the selected value of the concentration of methane in the off gas is greater than about 0.3%.

53. The method according to claim 51 comprising discontinuing introduction of fuel into the fragmented permeable mass, thereby extinguishing the secondary combustion zone when the concentration of methane in the off gas is greater than about 0.3% and the concentration of oxygen in the off gas is less than about 0.5%.

54. A method for igniting an in situ oil shale retort in a subterranean formation containing oil shale, the retort containing a fragmented permeable mass of formation particles containing oil shale, comprising the steps of:

(a) introducing a hot ignition gas having an oxygen concentration of about 5 percent into a fragmented permeable mass of formation particles in an in situ oil shale retort;

(b) withdrawing an off-gas from the retort;

(c) determining the concentration of oxygen in such retort off-gas;

(d) when the concentration of oxygen in the retort off-gas falls to less than about 3 percent, increasing the concentration of oxygen in the hot ignition gas to about 10 percent; then (e) discontinuing introduction of the hot ignition gas; and thereafter (f) introducing air into the fragmented permeable mass.

55. The method according to claim 54 comprising discontinuing introduction of hot ignition gas when the concentration of oxygen in the retort off gas decreases below about 2%.

56. A method for igniting an in situ oil shale retort in a subterranean formation containing oil shale, the retort containing a fragmented permeable mass of formation particles containing oil shale, comprising the steps of:

(a) introducing a hot ignition gas having an oxygen concentration of about 5 percent into a fragmented permeable mass of formation particles in an in situ oil shale retort for forming a combustion zone in the fragmented mass;

(b) monitoring off-gas from the retort for determining the concentration of oxygen contained therein;

(c) when the concentration of oxygen in the retort off-gas falls to less than about 3 percent, progressively increasing the concentration of oxygen in the hot ignition gas to about 10 percent; then (d) discontinuing introduction of the hot ignition gas; thereafter (e) introducing air into the retort for cooling the surface of the fragmented mass;

(f) monitoring the temperature of the surface of the fragmented mass; and (g) when the surface of the fragmented mass has been cooled below a selected temperature, introducing fuel and air into the retort for establishing a secondary combustion zone in the fragmented mass downstream from the cooled surface.

57. The method according to claim 56 wherein the selected temperature is about 1000° F.

58. The method according to claim 56 additionally comprising the steps of monitoring the retort off-gas for the concentration of a preselected constituent contained therein and discontinuing the introduction of fuel into the retort when the concentration of such constituent in the retort off-gas reaches a preselected value.

59. The method according to claim 58 wherein the preselected constituent is methane and fuel is discontinued being introduced into the retort when the concentration of methane in the retort off-gas reaches about 0.3 percent.

60. The method according to claim 56 comprising discontinuing introduction of hot ignition gas when the concentration of oxygen in the retort off gas decreases below about 2%.

* * * * *